US011294302B2

(12) United States Patent
Shin et al.

(10) Patent No.: US 11,294,302 B2
(45) Date of Patent: Apr. 5, 2022

(54) DEVELOPER CARTRIDGE WITH SPRING AUGER

(71) Applicant: HEWLETT-PACKARD DEVELOPMENT COMPANY, L.P., Spring, TX (US)

(72) Inventors: Youngkwang Shin, Suwon-si (KR); Seung-Chan Park, Suwon-si (KR); Dong-Uk Kim, Suwon-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/265,915

(22) PCT Filed: Jul. 23, 2019

(86) PCT No.: PCT/US2019/043020

§ 371 (c)(1),
(2) Date: Feb. 4, 2021

(87) PCT Pub. No.: WO2020/149881

PCT Pub. Date: Jul. 23, 2020

(65) Prior Publication Data

US 2021/0181655 A1 Jun. 17, 2021

(30) Foreign Application Priority Data

Jan. 16, 2019 (KR) ..... 10-2019-0005537

(51) Int. Cl.
*G03G 15/08* (2006.01)

(52) U.S. Cl.
CPC ..... *G03G 15/0867* (2013.01); *G03G 15/0865* (2013.01); *G03G 15/0891* (2013.01)

(58) Field of Classification Search
CPC ..... G03G 15/0865; G03G 15/0867; G03G 15/0868; G03G 15/087; G03G 15/0872; G03G 15/0891
See application file for complete search history.

(56) References Cited

U.S. PATENT DOCUMENTS 4,739,907 A * 4/1988 Gallant ..... G03G 15/0877 222/240
4,943,830 A 7/1990 Sulenski
(Continued)

FOREIGN PATENT DOCUMENTS

EP 0289284 11/1988
JP H07114301 5/1995
(Continued)

*Primary Examiner* — Carla J Therrien
(74) *Attorney, Agent, or Firm* — Trop Pruner & Hu, P.C.

(57) ABSTRACT

A developer cartridge including a housing, a spring auger, and a rotation member. The housing accommodating a developer and including a first end portion and a second end portion in a lengthwise direction. The housing is to discharge the developer through a developer discharge outlet coupled to the housing and adjacent to one of the first end portion and the second end portion. The spring auger is located inside the housing and is to rotate to transport the developer to the developer discharge outlet. The rotation member is located at the first end portion of the housing and connected to a first end of the spring auger to rotate the spring auger. A first portion of a bottom surface of the housing is flat and a second portion of the bottom surface is internally convex from the first portion are repeatedly arranged on the bottom surface in the lengthwise direction.

17 Claims, 10 Drawing Sheets

(56) References Cited

U.S. PATENT DOCUMENTS

| | | | | |
|---|---|---|---|---|
| 5,139,176 | A | 8/1992 | Reindl et al. | |
| 5,289,955 | A * | 3/1994 | Sulenski | G03G 15/0877 222/333 |
| 5,331,382 | A | 7/1994 | Miura et al. | |
| 2012/0243913 | A1 | 9/2012 | Murata et al. | |
| 2013/0195509 | A1 | 8/2013 | Takahashi et al. | |
| 2014/0270855 | A1* | 9/2014 | Wegman | G03G 15/0867 399/262 |
| 2015/0248102 | A1 | 9/2015 | Nakajima | |
| 2018/0113398 | A1 | 4/2018 | Yukimoto et al. | |
| 2019/0235414 | A1* | 8/2019 | Katsumata | G03G 15/0867 |

FOREIGN PATENT DOCUMENTS

| | | | |
|---|---|---|---|
| JP | 2005055590 | | 3/2005 |
| JP | 2008102533 | A * | 5/2008 |
| RU | 2698477 | C2 | 8/2019 |
| WO | WO-2014147846 | A1 | 9/2014 |

* cited by examiner

DEVELOPER CARTRIDGE WITH SPRING AUGER

BACKGROUND

In a printer using an electrophotographic method, toner is supplied to an electrostatic latent image formed on a photoconductor to form a visible toner image on the photoconductor, and the toner image is transferred via an intermediate transfer medium or directly to a print medium and then the transferred toner image is fixed on the print medium.

Toner is a developer and is accommodated in a developer cartridge. A developer cartridge is a consumable that is replaced when a developer contained therein is used up. A replacement time of the developer cartridge may be determined by detecting a remaining amount of the developer in the developer cartridge.

DETAILED DESCRIPTION OF EXAMPLES

Figure 1:
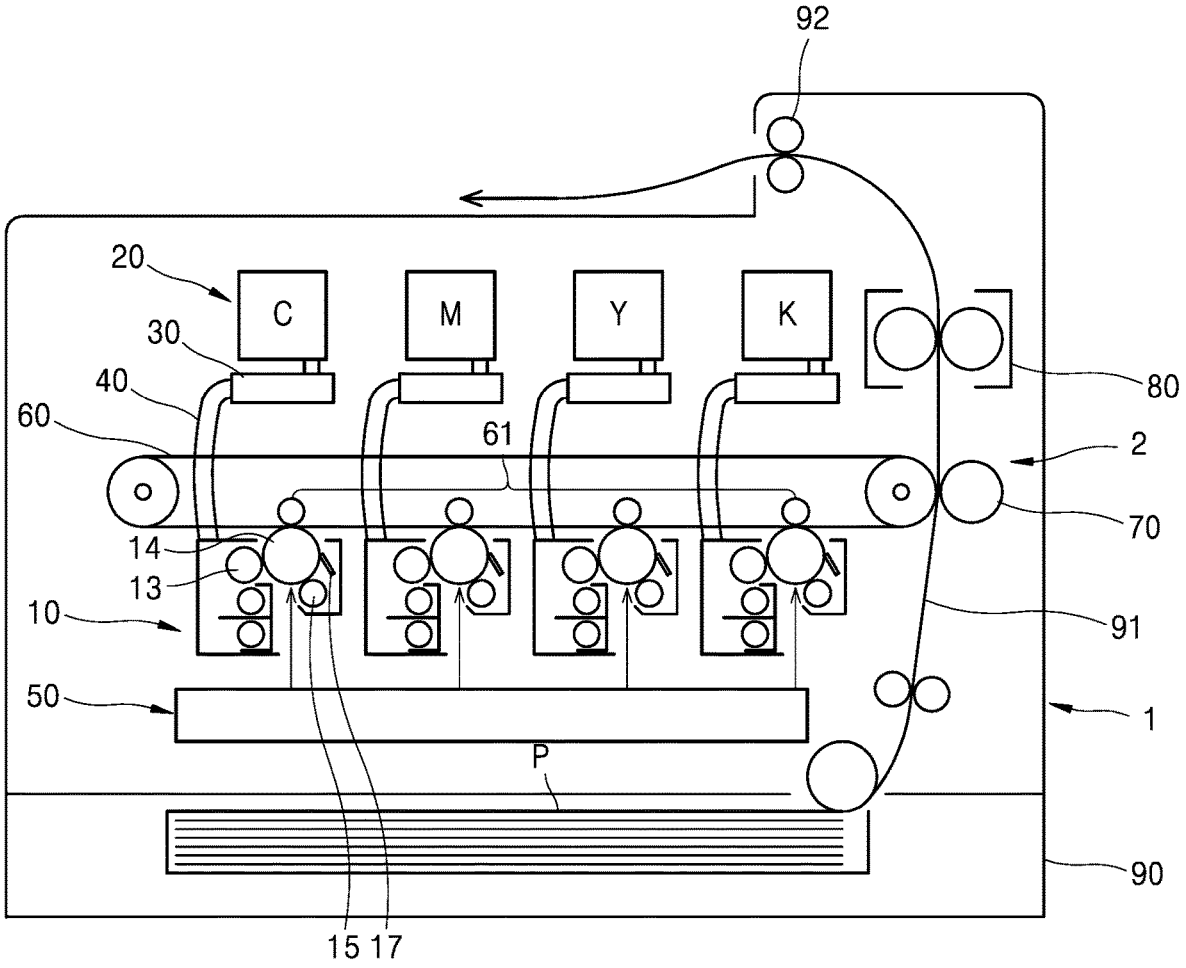
FIG. 1 is a schematic structural diagram of an electrophotograpic printer according to an example.

FIG. 1 is a schematic structural diagram of an electrophotographic printer (image forming apparatus) according to an example. Referring to FIG. 1, the printer includes a main body 1 and a developer cartridge 20 that is attachable to/detachable from the main body 1. The main body 1 includes a printing unit 2 printing an image on a print medium P by using an electrophotographic method. The printing unit 2 according to the present example prints a color image on a print medium P by using an electrophotographic method. The printing unit 2 may include a plurality of developing devices 10, an exposure device 50, a transfer unit, and a fixing unit 80. The developer cartridge 20 accommodates a developer to be supplied to the printing unit 2. The printer may include a plurality of developer cartridges 20 accommodating a developer. The plurality of developer cartridges 20 are respectively connected to the plurality of developing devices 10, and a developer accommodated in the plurality of developer cartridges 20 is supplied to each of the plurality of developing devices 10. A developer supplying unit 30 receives a developer from the developer cartridge 20 and supplies the same to the developing devices 10. The developer supplying unit 30 is connected to the developing devices 10 via a supply pipeline 40. Although not illustrated in the drawing, the developer supplying unit 30 may be omitted, and the supply pipeline 40 may directly connect the developer cartridge 20 to the developing devices 10.

The plurality of developing devices 10 may include a plurality of developing devices 10C, 10M, 10Y, and 10K that are used to form toner images of cyan (C), magenta (M), yellow (Y), and black (K) colors, respectively. In addition, the plurality of developer cartridges 20 may include a plurality of developer cartridges 20C, 20M, 20Y, and 20K respectively accommodating developers of cyan (C), magenta (M), yellow (Y), and black (K) colors to be respectively supplied to the plurality of developing devices 10C, 10M, 10Y, and 10K. However, the scope of the disclosure is not limited thereto. The printer may further include other developer cartridges 20 and developing devices 10 to accommodate and develop developers of other various colors such as light magenta or white in addition to the above-described colors. Hereinafter, a printer including the plurality of developing devices 10C, 10M, 10Y, and 10K and the plurality of developer cartridges 20C, 20M, 20Y, and 20K will be described, and unless otherwise described, elements labeled C, M, Y, and K below respectively refer to elements for developing developers of cyan (C), magenta (M), yellow (Y), and black (K) colors, The developing devices 10 may each include a photosensitive drum 14, on a surface of which an electrostatic latent image is formed, and a developing roller 13 supplying a developer to the electrostatic latent image to develop the electrostatic latent image into a visible toner image. The photosensitive drum 14 is an example of a photosensitive body, on a surface of which an electrostatic latent image is formed, and may include a conductive metal pipe and a photosensitive layer formed on an outer circumference thereof. A charging roller 15 is an example of a charging device charging the photosensitive drum 14 to have a uniform surface potential. Instead of the charging roller 15, a charging brush or a corona charging device or the like may also be used.

The developing devices 10 may further include a charging roller cleaner (not illustrated) removing a developer or foreign substances such as dust attached on the charging roller 15, a cleaning member 17 removing a developer remaining on a surface of the photosensitive drum 14 after an intermediate transfer process to be described later, a regulation member regulating an amount of a developer supplied to a developing region in which the photosensitive drum 14 and the developing roller 13 face each other. The cleaning member 17 may be, for example, a cleaning blade that contacts a surface of the photosensitive drum 14 to scrape the developer. Although not illustrated in FIG. 1, the cleaning member 17 may be a cleaning brush that rotates to contact a surface of the photosensitive drum 14 and scrape the developer.

A developer accommodated in the developer cartridge 20, that is, toner and carrier, is supplied to the developing devices 10. The developing roller 13 may be spaced apart from the photosensitive drum 14. A distance between an outer circumferential surface of the developing roller 13 and an outer circumferential surface of the photosensitive drum 14 may be, for example, about several tens to about several hundreds of microns. The developing roller 13 may be a magnetic roller. In addition, the developing roller 13 may have a form in which a magnet is disposed in a rotating developing sleeve. In the developing devices 10, toner is mixed with a carrier, and the toner is attached to a surface of a magnetic carrier. The magnetic carrier is attached to a surface of the developing roller 13 and transported to the developing region in which the photosensitive drum 14 and the developing roller 13 face each other. A regulating member (not shown) regulates an amount of the developer transported to the developing region. Via a developing bias voltage applied between the developing roller 13 and the photosensitive drum 14, the toner is supplied to the photosensitive drum 14 so as to develop an electrostatic latent image formed on a surface of the photosensitive drum 14 into a visible toner image.

The exposure device 50 radiates light modulated according to image information, onto the photosensitive drum 14, to thereby form an electrostatic latent image on the photosensitive drum 14. Examples of the exposure device 50 may be a laser scanning unit (LSU) using a laser diode as a light source or a light-emitting diode (LED) exposure device that uses an LED as a light source.

The transfer device transfers the toner image formed on the photosensitive drum 14, onto a print medium P. In the present example, a transfer device that uses an intermediate transfer method is used. For example, the transfer device may include an intermediate transfer belt 60, a plurality of intermediate transfer rollers 61, and a transfer roller 70.

The intermediate transfer belt 60 temporarily accommodates the toner image developed on the photosensitive drum 14 of the plurality of developing devices 10C, 10M, 10Y, and 10K. The plurality of intermediate transfer rollers 61 are disposed to face the photosensitive drum 14 of the plurality of developing devices 10C, 10M, 10Y, and 10K, with the intermediate transfer belt 60 therebetween. An intermediate transfer bias voltage used to intermediately transfer the toner image developed on the photosensitive drum 14, to the intermediate transfer belt 60, is applied to the plurality of intermediate transfer rollers 61. Instead of the intermediate transfer rollers 61, a corona transfer device or a pin scorotron transfer device may be used.

The transfer roller 70 is disposed to face the intermediate transfer belt 60. A transfer bias voltage for transferring the toner image transferred to the intermediate transfer belt 60, to the print medium P, is applied to the transfer roller 70.

The fixing unit 80 fixes the toner image transferred to the print medium P, on the print medium P, by applying heat and/or pressure to the toner image. The form of the fixing unit 80 is not limited to that illustrated in FIG. 1.

According to the above-described configuration, the exposure device 60 radiates light modulated according to image information of the colors onto the photosensitive drum 14 of the plurality of developing devices 10C, 10M, 10Y, and 10K to form an electrostatic latent image on the photosensitive drum 14. The electrostatic latent image of the photosensitive drum 14 of the plurality of developing devices 10C, 10M, 10Y, and 10K is developed into a visible toner image by using the C, M, Y, and K developers supplied from the plurality of developer cartridges 20C, 20M, 20Y, and 20K to the plurality of developing devices 10C, 10M, 10Y, and 10K. The developed toner images are sequentially intermediately transferred to the intermediate transfer belt 60. The print medium P loaded in a feeding unit 90 is transported along a feeding path 91 between the transfer roller 70 and the intermediate transfer belt 60. Due to a transfer bias voltage applied to the transfer roller 70, the toner images that are intermediately transferred onto the intermediate transfer belt 60 are transferred to the print medium P. When the print medium P passes through the fixing unit 80, the toner images are fixed to the print medium P by heat and pressure. The print medium P, with which fixing is completed is discharged using a discharge roller 92.

The plurality of developer cartridges 20 are attachable to/detachable from the main body 1 and may be individually replaceable. When the developer accommodated in the developer cartridge 20 is completely consumed, the developer cartridge 20 may be replaced with a new developer cartridge 20. When a mono-component development method is used, a developer accommodated in the developer cartridge 20 may be toner. When a dual-component development method is used, a developer accommodated in the developer cartridge 20 may be toner or toner and carrier. The developer cartridge 20 may also be referred to as a 'toner cartridge.'

Figure 2:
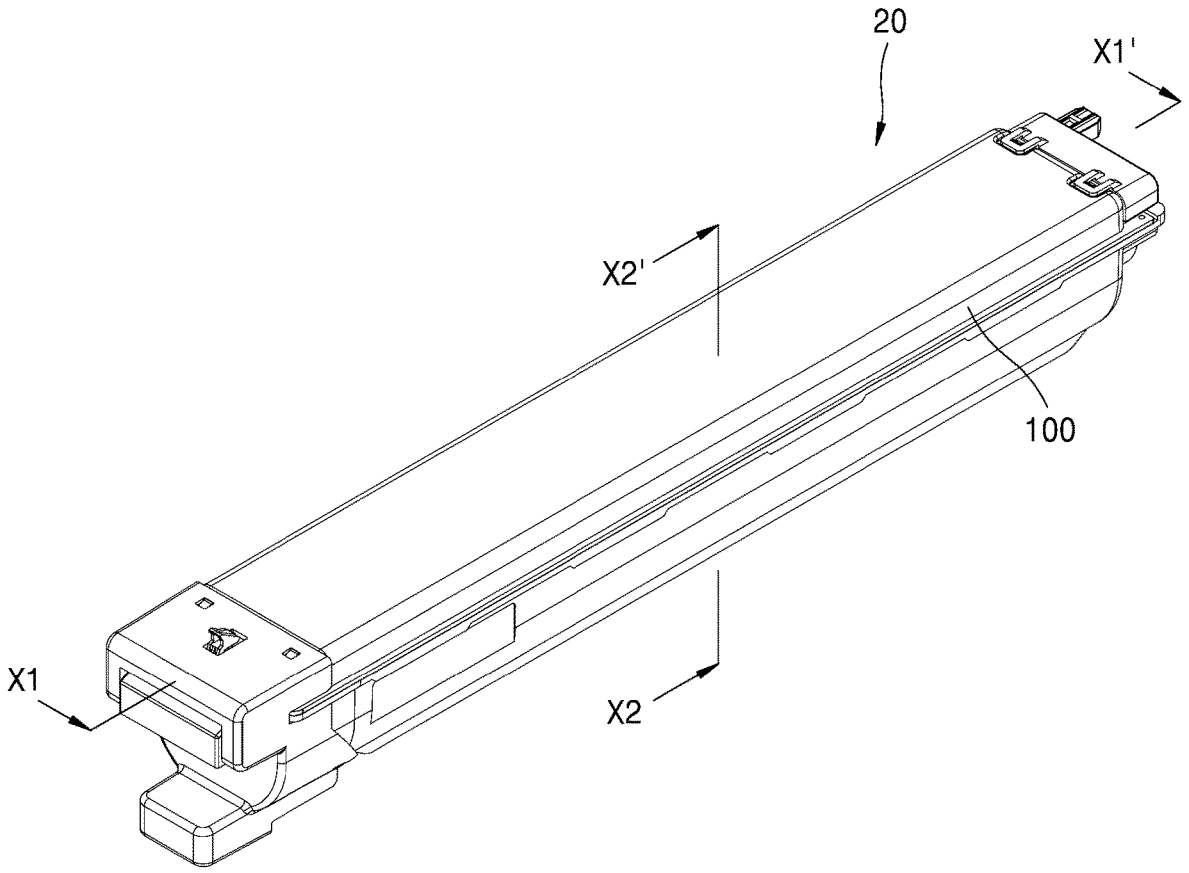
FIG. 2 is a perspective view of a developer cartridge according to an example.
Figure 3:
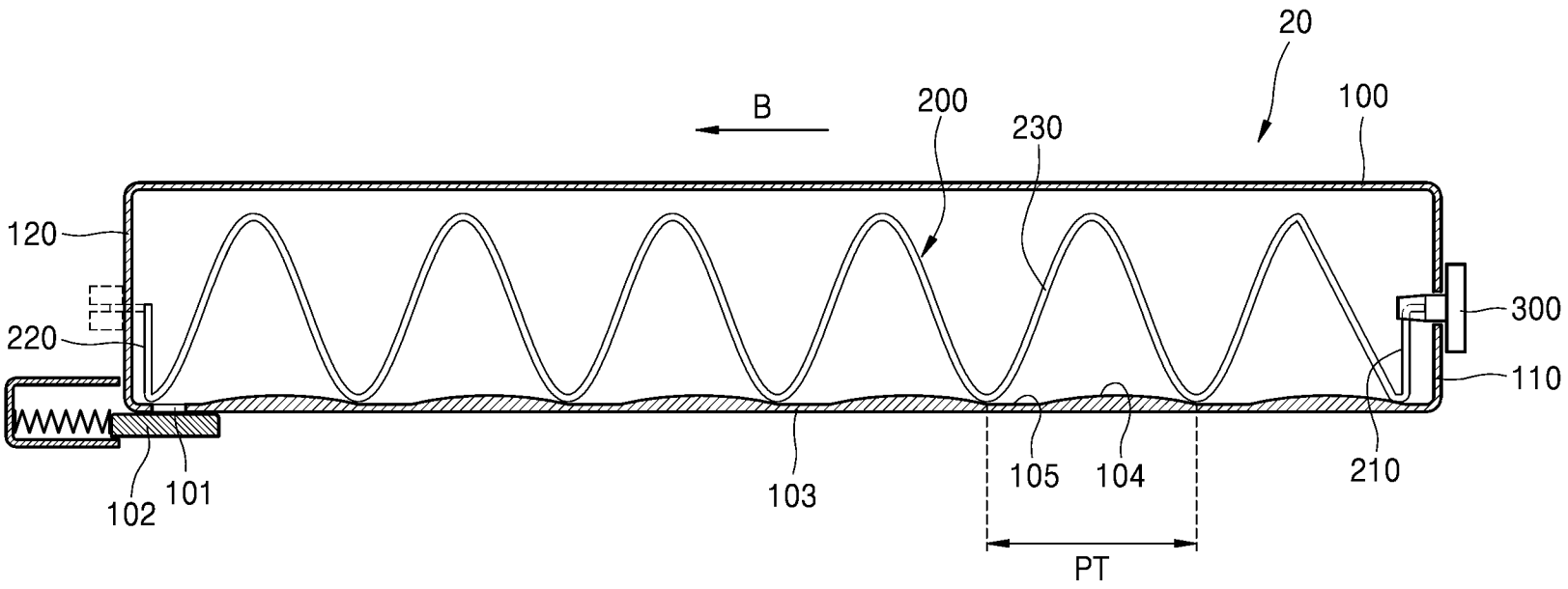
FIG. 3 is a cross-sectional view of the developer cartridge of FIG. 2 taken along X1-X1'.
Figure 4:
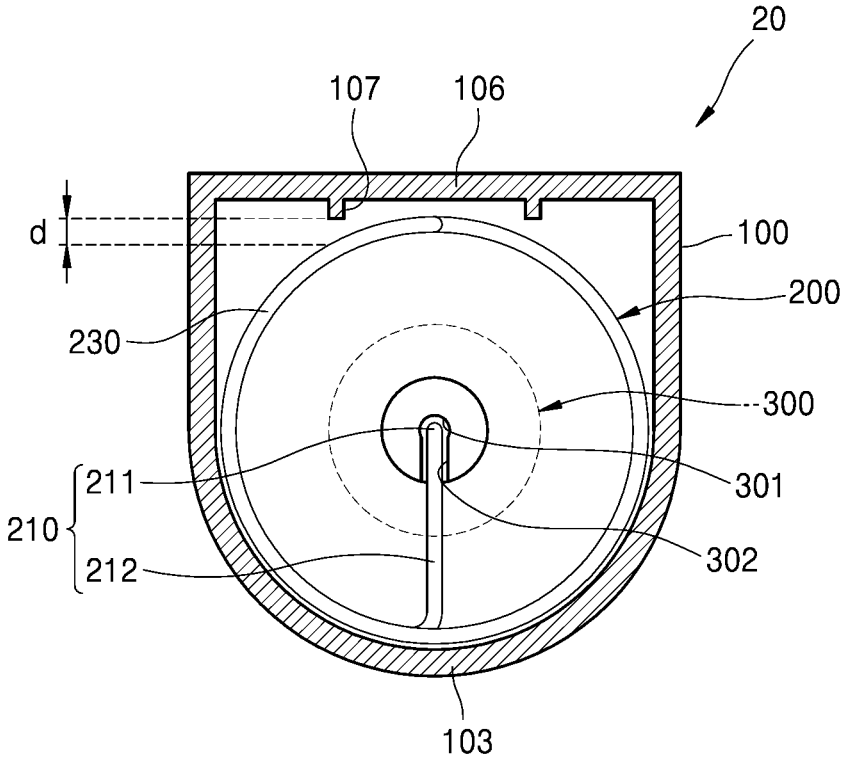
FIG. 4 is cross-sectional view of the developer cartridge of FIG. 2 taken along X2-X2'.

FIG. 2 is a perspective view of a developer cartridge 20 according to an example. FIG. 3 is a cross-sectional view of the developer cartridge 20 of FIG, 2 taken along X1-X1'. FIG. 4 is a cross-sectional view of the developer cartridge 20 of FIG. 2 taken along X2-X2'.

Referring to FIGS. 2 and 3, the developer cartridge 20 may include housing 100, a spring auger 200, and a rotation member 300.

A developer is accommodated in the housing 100. The housing 100 includes a first end portion 110 and a second end portion 120 that are spaced apart from each other in a length direction B. A developer discharge outlet 101 through which a developer is discharged is provided at a position adjacent to one of the first end portion 110 and the second end portion 120. In the present example, the developer discharge outlet 101 is located, adjacent to the second end portion 120. A shutter 102 selectively opening or closing the developer discharge outlet 101 may be provided in an outer portion of the developer discharge outlet 101. A developer may be supplied to the developing devices 10 through the developer discharge outlet 101. The supply pipeline 40 (FIG. 1) may be connected to the developer discharge outlet 101. The developer discharge outlet 101 may also be connected to the developer supplying unit 30 (FIG. 1). In addition, although not illustrated in the drawings, the developer discharge outlet 101 may also be directly connected to the developing devices 10.

The spring auger 200 is located inside the housing 100 and rotated to transport a developer to the developer discharge outlet 101. The spring auger 200 has a spiral coil shape as illustrated in FIG. 3. The rotation member 300 is located at the first end portion 110 of the housing 100, and is connected to the spring auger 200 to rotate the spring auger 200. One end 210 of the spring auger 200 is connected to the rotation member 300.

A connection structure between the rotation member 300 and the spring auger 200 according to an example will be described with reference to FIGS. 3 and 4. The spring auger 200 may include a connection portion 211 connected to the rotation member 300, an extension portion 212 extending from the connection portion 211 in a radial direction, and a spiral portion 230 extending from the extension portion 212 toward the second end portion 120 of the housing 100 in a length direction B in a spiral shape. The one end 210 of the spring auger 200 may include the connection portion 211 and the extension portion 212 described above. The other end 220 of the spring auger 200 is an end opposite to the one end 210 with the spiral portion 230 included therebetween.

The connection portion 211 may extend, for example, in an axial direction of the spring auger 200. The connection portion 211 may be inserted into an insertion hole 301 provided in, for example, the rotation member 300. The extension portion 212 is inserted into a slit 302 cut in the rotation member 300 in a radial direction. When the rotation member 300 is rotated, a sidewall of the slit 302 pushes the extension portion 212, thereby rotating the spring auger 200. The rotation member 300 may be, for example, a gear or a coupler. When the developer cartridge 20 is mounted in the main body 1, the rotation member 300 may be connected to a developer supply motor (not shown) provided in the main body 1. The rotation member 300 may be connected to a developer supply motor (not shown) provided in the developer cartridge 20.

The other end 220 of the spring auger 200 may be, a free end that is not restricted by the housing 100. In other words, as illustrated in FIG. 3, the other end 220 of the spring auger 200 may not be connected to the second end portion 120 of the housing 100 but may be located adjacent to the second end portion 120 of the housing 100. As another example, the other end 220 of the spring auger 200 may be rotatably supported in the housing 100. For example, as illustrated by a broken line in FIG. 3, the other end 220 of the spring auger 200 may be rotatably supported by the second end portion 120 of the housing 100.

When the spring auger 200 is rotated, the spiral portion 230 of the spring auger 200 contacts a bottom surface 103 of the housing 100, transporting toner in the housing 100 in the length direction B toward the developer discharge outlet 101. When the spring auger 200 is rotated, according to a rotational phase of the spring auger 200, the spiral portion 230 of the spring auger 200 may be spaced apart from the bottom surface 103 of the housing 100.

Figure 5:
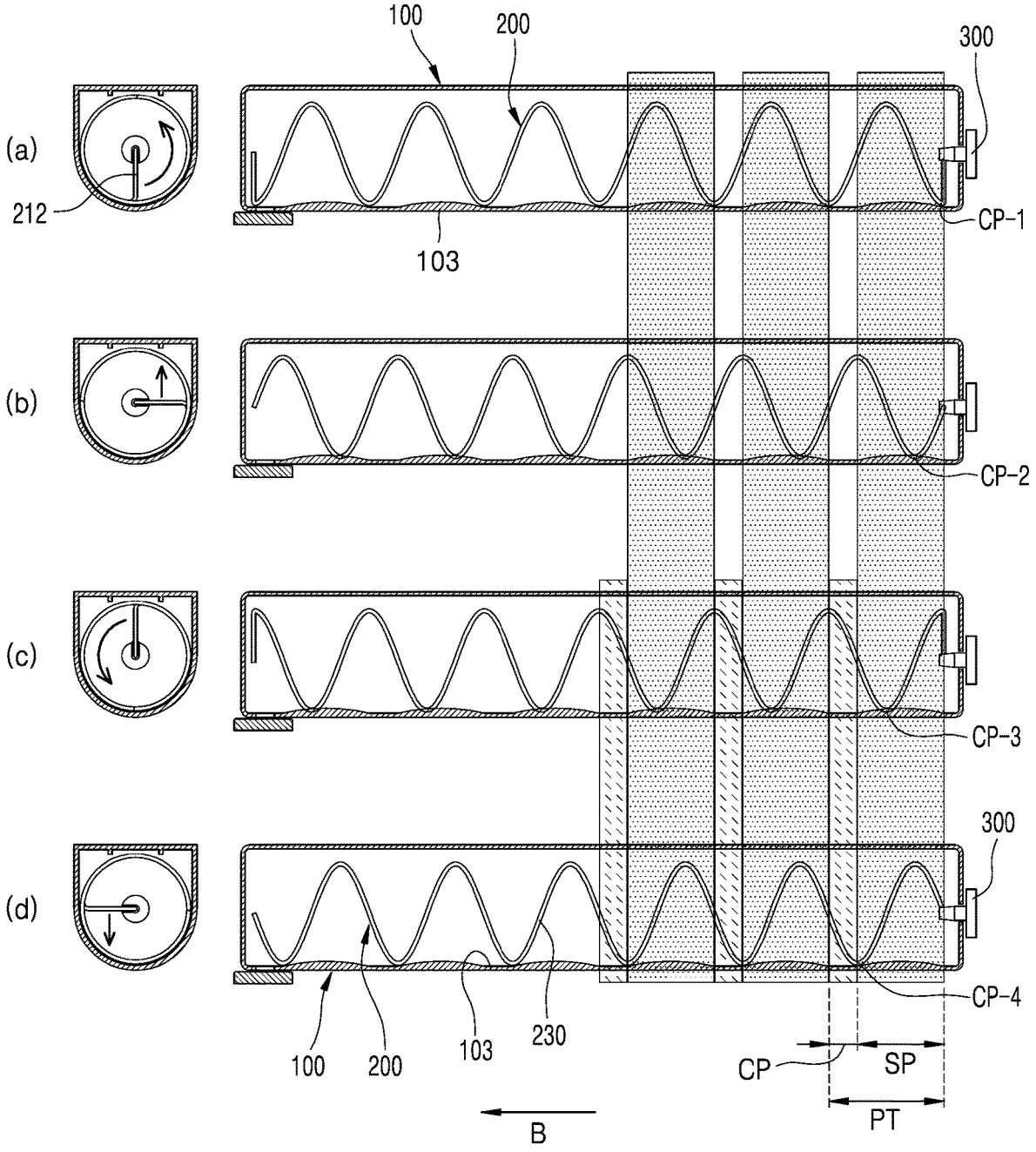
FIG. 5 shows a change in a state of contact between a spiral portion of a spring auger and a bottom surface of a housing according to a rotational phase of the spring auger.

FIG. 5 illustrates a change in a state of contact between the spiral portion 230 of the spring auger 200 and the bottom surface 103 of the housing 100 according to a rotational phase, of the spring auger 200. Referring to (a) of FIG. 5, a position where the extension portion 212 of the spring auger 200 faces the bottom surface 103 is referred to as a reference rotational position of the spring auger 200. Here, the spiral portion 230 is in contact with the bottom surface 103. In this state, when the spring auger 200 starts rotating in a counterclockwise direction, the spiral portion 230 is moved in the length direction B. Here, as the spring auger 200 is twisted by rotational moment of the spring auger 200, the spiral portion 230 starts being spaced apart from the bottom surface 103. As the spring auger 200 passes the reference rotational position to a position where it is rotated by 90 degrees ((b) of FIG. 5) and then to a position where it is rotated by 180 degrees ((c) of FIG. 5), a distance between the spiral portion 230 and the bottom surface 103 may be gradually increased. The distance between the spiral portion 230 and the bottom surface 103 may be greatest when the spring auger 200 has reached a position where it is rotated by 180 degrees ((c) of FIG. 5) from the reference rotational position. When a rotational position of the spring auger 200 passes the position where it is rotated by 180 degrees, illustrated in (c) of FIG. 5, from the reference rotational position, the spiral portion 230 starts descending toward the bottom surface 103. The spring auger 200 then passes the position where it is rotated by 270 degrees ((d) of FIG. 5) from the reference rotational position and reaches again the reference rotational position illustrated in (a) of FIG. 5.

When the bottom surface 103 is flat in the length direction B, a process that the spiral portion 230 is spaced apart from the bottom surface 103 and then contacts the bottom surface 103 again according to a rotational phase of the spring auger 200 is repeated during rotation of the spring auger 200. Accordingly, a period of separation SP and a period of contact CP in the length direction B are repeated, and a repeat cycle of the period of separation SP and the period of contact CP is equal to a pitch PT of the spiral portion 230.

As no developer is transported in the period of separation SP, at a time when the developer in the housing 100 is almost exhausted, the developer remains in an area of the bottom surface 103 corresponding to the period of separation SP. This developer is referred to as residual developer. The residual developer is present at various positions on the bottom surface 103 at certain distances in the length direction B, that is, at the pitch PT of the spiral portion 230. Even when the spring auger 200 is rotated, the residual developer is not transported to the developer discharge outlet 101, and thus is not used in printing.

Thus, a method to reduce an amount of residual developer is needed to increase a use efficiency of developer accommodated in the developer cartridge 20. According to the developer cartridge 20 of the present example, a first portion 105 that is flat and a second portion 104 that is internally convex from the first portion 105 are formed on the bottom surface 103 of the housing 100. The first portion 105 and the second portion 104 are repeatedly arranged in the length direction B. A repeated arrangement cycle of the first portion 105 and the second portion 104 is equal to a pitch of the spring auger 200, that is, the pitch PT of the spiral portion 230.

The first portion 105 may be formed to correspond to a period of contact CP, and the second portion 104 may be formed to correspond to a period of separation SP. According to this configuration, the spiral portion 230 may be maintained in a contacted state with respect to the second portion 104 that is internally convex, in the period of separation P. Accordingly, a developer may be continuously transported toward the developer discharge outlet 101 also in the period of separation SP, thus reducing or preventing the occurrence of residual developer.

The first portion 105 and the second portion 104 are formed in synchronization with a rotational phase of the extension portion 212 of the spring auger 200. For example, while the extension portion 212 is respectively located at a reference rotational position, a position rotated from the reference rotational position by 90 degrees, a position rotated from the reference rotational position by 180 degrees, and a position rotated from the reference rotational position by 270 degrees, respective positions where the spiral portion 230 faces the bottom surface 103 are respectively referred to as a first position CP-1, a second position CP-2, a third position CP-3, and a fourth position CP4. The second portion 104 may start from the first position CP-1 corresponding to the reference rotational position of the extension portion 212.

A length of the second portion 104 may be longer than a length of the first portion 105. Accordingly, the bottom surface 103 may be in stable contact with the spiral portion 230, thereby effectively reducing or preventing the occurrence of residual developer. In other words, with respect to a rotational phase of the extension portion 212, a section from the reference rotational position to the position rotated by 180 degrees is a section where the spiral portion 230 is spaced apart from the bottom surface 103, and thus, the second portion 104 may be formed from the first position CR-1 and at least to the third position CP-3. A protrusion amount of the second portion 104 may be in a smooth curve shape which gradually increases from the first position CP-1 and then gradually decreases again until the third position CP-3 is reached.

When a rotational phase of the extension portion 212 exceeds the 180-degree rotated position, the spiral portion 230 may descend toward the bottom surface 103 and contact the bottom surface 103 in a certain rotational position. The second portion 104 may be formed up to the fourth position CP-4 to minimize an amount of residual developer. A protrusion amount of the second portion 104 may be in a smooth curve shape which gradually increases from the first position CP-1 and then gradually decreases again until the fourth position CP-4 is reached.

Referring to FIG. 4, a regulation protrusion 107 protruding downwards to regulate an upward flow of the spring auger 200 is provided on an upper wall 106 of the housing 100. The regulation protrusion 107 is spaced apart from the spiral portion 230 of the spring auger 200 by a distance d. The distance d may be, for example, 1.5 mm or less. A protrusion amount of the second portion 104 may be the distance d or less.

As the extension portion 212 affects generation of the period of separation SP, the period of separation SP is likely to occur at a portion of the housing 100 close to the first end portion 110. When the other end 220 of the spring auger 200 is a free end, the other end 220 may sag toward the bottom surface 103 due to gravity, and thus, the period of separation SP is less likely to occur at a portion of the housing 100 close to the second end portion 120. Also when the other end 220 of the spring auger 200 is rotatably supported by the housing 100, the period of separation SP may be less generated at a portion of the housing 100 close to the second end portion 120. Considering these characteristics, the first portion 105 and the second portion 104 may be repeatedly arranged at least from the first end portion 110 of the housing 100 to a section corresponding to a half or more of a distance between the first end portion 110 and the second end portion 120. The first portion 105 and the second portion 104 may also be repeatedly arranged in the entire section between the first end portion 110 and the second end portion 120 of the housing 100.

As a method of reducing or eliminating an amount of residual developer in the period of separation SP, moving the period of separation SP may be considered. As described above, a plurality of periods of separation SP are formed in the length direction B of the housing 100 on a cycle corresponding to the pitch PT of the spiral portion 230 of the spring auger 200. Accordingly, by modifying the pitch PT of the spiral portion 230 of the spring auger 200, a position of the period of separation SP may be varied, and a developer remaining in the period of separation SP in a position before the position thereof is varied may be transported to the developer discharge outlet 101.

Figure 6:
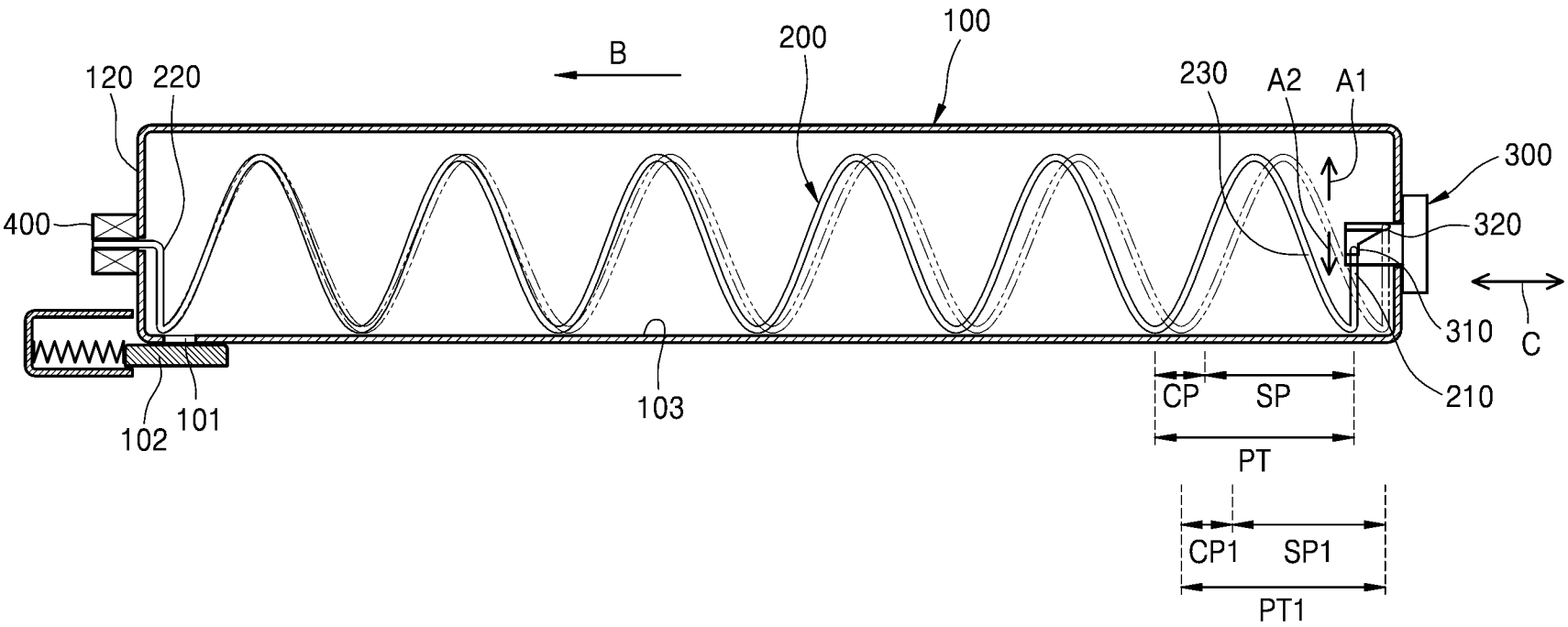
FIG. 6 is a perspective view of a developer cartridge according to an example.

FIG. 6 is a perspective view of a developer cartridge 20 according to an example. Referring to FIG. 6, the developer cartridge 20 may include a housing 100, a spring auger 200, and a rotation member 300.

A developer is accommodated in the housing 100. The housing 100 includes a first end portion 110 and a second end portion 120 in a length direction B. A bottom surface 103 of the housing 100 is flat. A developer discharge outlet 101 through which a developer is discharged is provided at a position adjacent to one of the first end portion 110 and the second end portion 120. In the present example, the developer discharge outlet 101 is located adjacent to the second end portion 120. A shutter 102 selectively opening or closing the developer discharge outlet 101 may be provided in an outer portion of the developer discharge outlet 101. A developer may be supplied to the developing devices 10 through the developer discharge outlet 101. The supply pipeline 40 (FIG. 1) may be connected to the developer discharge outlet 101. The developer discharge outlet 101 may be connected to the developer supplying unit 30 (FIG. 1). In addition, although not illustrated in the drawings, the developer discharge outlet 101 may also be directly connected to the developing devices 10.

The spring auger 200 is located inside the housing 100 and rotated in a forward direction A1 to transport a developer to the developer discharge outlet 101. The spring auger 200 has a spiral coil shape as illustrated in FIG. 6.

The rotation member 300 is located at the first end portion 110 of the housing 100, and is connected to the spring auger 200 to rotate the spring auger 200 in the forward direction A1. A one end 210 of the spring auger 200 is connected to the rotation member 300. The rotation member 300 includes a first support portion 310 supporting the one end 210 of the spring auger 200 and a second support portion 320 located in the forward direction A1 of the first support portion 310 and having a position in an axial direction C different from a position of the first support portion 310. The second support portion 320 may be closer to the first end portion 110 in the axial direction C than the first support portion 310. The spring auger 200 is supported in a compressed state between the rotation member 300 and the second end portion 120 of the housing 100 such that the one end 210 of the spring auger 200 is deviated from the first support portion 310 and supported by the second support portion 320 when the rotation member 300 is rotated in a reverse direction A2 opposite to the forward direction A1.

The developer cartridge 20 may further include a one-directional bearing 400 that is located at the second end portion 120 of the housing 100 to support the other end 220 of the spring auger 200 and allows rotation of the spring auger 200 in the forward direction A1. The one-directional bearing 400 does not allow rotation of the spring auger 200 in the reverse direction A2. Thus, when the rotation member 300 is rotated in the reverse direction AZ the first end 210 of the spring auger 200 may be easily deviated from the first support portion 310 and supported by the second support portion 320.

The rotation member 300 may be, for example, a gear or a coupler. When the developer cartridge 20 is mounted in the main body 1, the rotation member 300 may be connected to a developer supply motor (not shown) provided in the main body 1. The rotation member 300 may be connected to a developer supply motor (not shown) provided in the developer cartridge 20.

Figure 7:
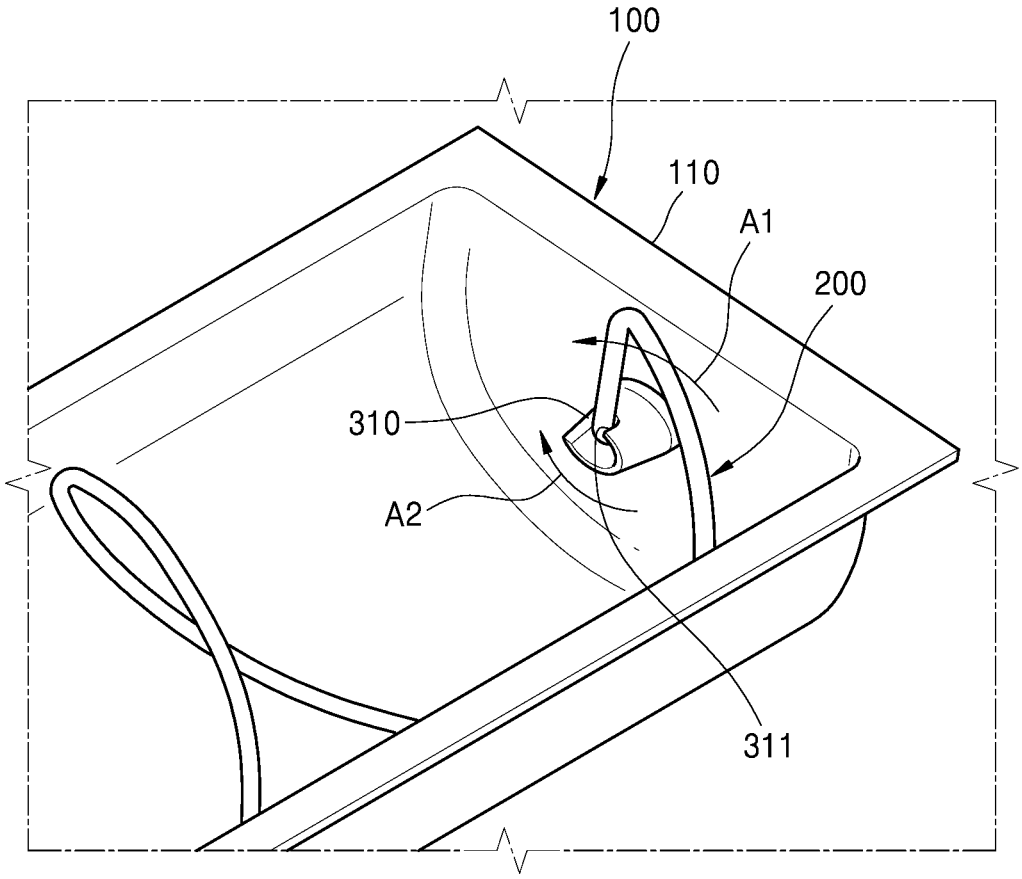
FIG. 7 is a perspective view illustrating a connection structure between a rotation member and one end of a spring auger, according to an example, where the end of the spring auger is supported by a first support portion.
Figure 8:
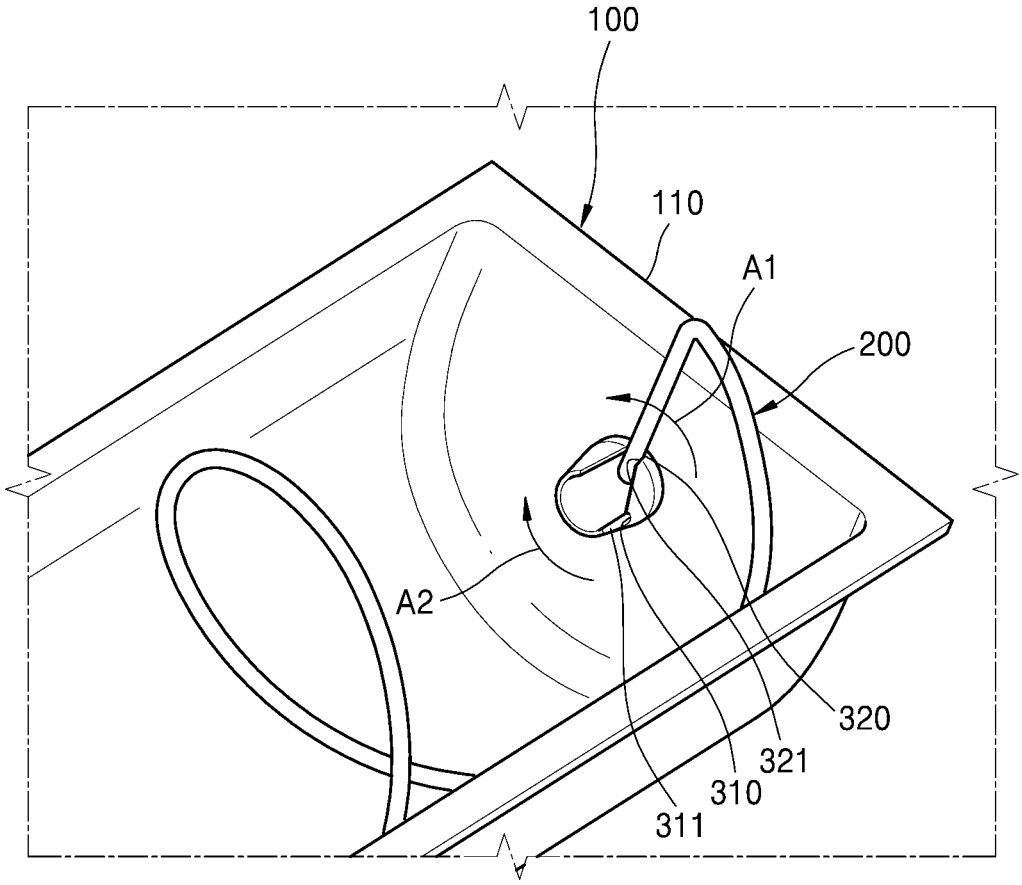
FIG. 8 is a perspective view illustrating a connection structure between a rotation member and one end of a spring auger, according to an example, where the end of the spring auger is supported by a second support portion.

FIG. 7 is a perspective view illustrating a connection structure between the rotation member 300 and the one end 210 of the spring auger 200, according to an example, where the one end 210 of the spring auger 200 is supported by the first support portion 310. FIG. 8 is a perspective view illustrating a connection structure between the rotation member 300 and the one end 210 of the spring auger 200, according to an example, where the one end 210 of the spring auger 200 is supported by the second support portion 320.

Referring to FIGS. 6 and 7, while the one end 210 of the spring auger 200 is supported by the first support portion 310 (marked by a solid line in FIG. 6), a pitch of the spring auger 200 is PT. In this state, when the rotation member 300 is rotated in the forward direction A1, a wall 311 of the first support portion 310 in the reverse direction A2 pushes the one end 210 of the spring auger 200 in the forward direction A1. The spring auger 200 is rotated in the forward direction A1 and thereby transports a developer to the developer discharge outlet 101. As the bottom surface 103 is flat, as described with reference to FIG. 5, a period of separation SP and a period of contact CP are formed at pitches PT of the spiral portion 230. Accordingly, a developer may remain in an area of the bottom surface 103 corresponding to the period of separation SP.

In the state as illustrated in FIG. 7, the rotation member 300 is rotated in the reverse direction A2. As the spring auger 200 is supported in a compressed state between the rotation member 300 and the second end portion 120 of the housing 100, the spring auger 200 is not rotated. When the rotation member 300 is rotated in the reverse direction A2. the one end 210 of the spring auger 200 is deviated from the first support portion 310 and supported by the second support portion 320 as illustrated in FIG. 8. As the second support portion 320 is closer to the first end portion 110 in the axial direction C than the first support portion 310, as marked by a broken line in FIG. 6, the spring auger 200 is tensioned in the length direction B. In this state, when the rotation member 300 is rotated again in the forward direction A1, a wall 321 of the second support portion 320 in the reverse direction A2 pushes the one end 210 of the spring auger 200 in the forward direction A1. The spring auger 200 is rotated in the forward direction A1 and thereby transports a developer to the developer discharge outlet 101.

Referring to FIG. 6, while the one end 210 of the spring auger 200 is supported by the second support portion 320, a pitch of the spring auger 200 is PT1, and PT<PT1. While the one end 210 of the spring auger 200 is supported by the second support portion 320, a period of separation SP1 and a period of contact CP2 are respectively different from the period of separation SP and the period of contact CP while the one end 210 of the spring auger 200 is supported by the first support portion 310. A portion of the period of separation SP overlaps the period of contact CP1. Thus, at least a portion of the developer remaining in the area corresponding to the period of separation SP of the bottom surface 103 may be transported to the developer discharge outlet 101, and a use efficiency of the developer may be increased accordingly.

Figure 9:
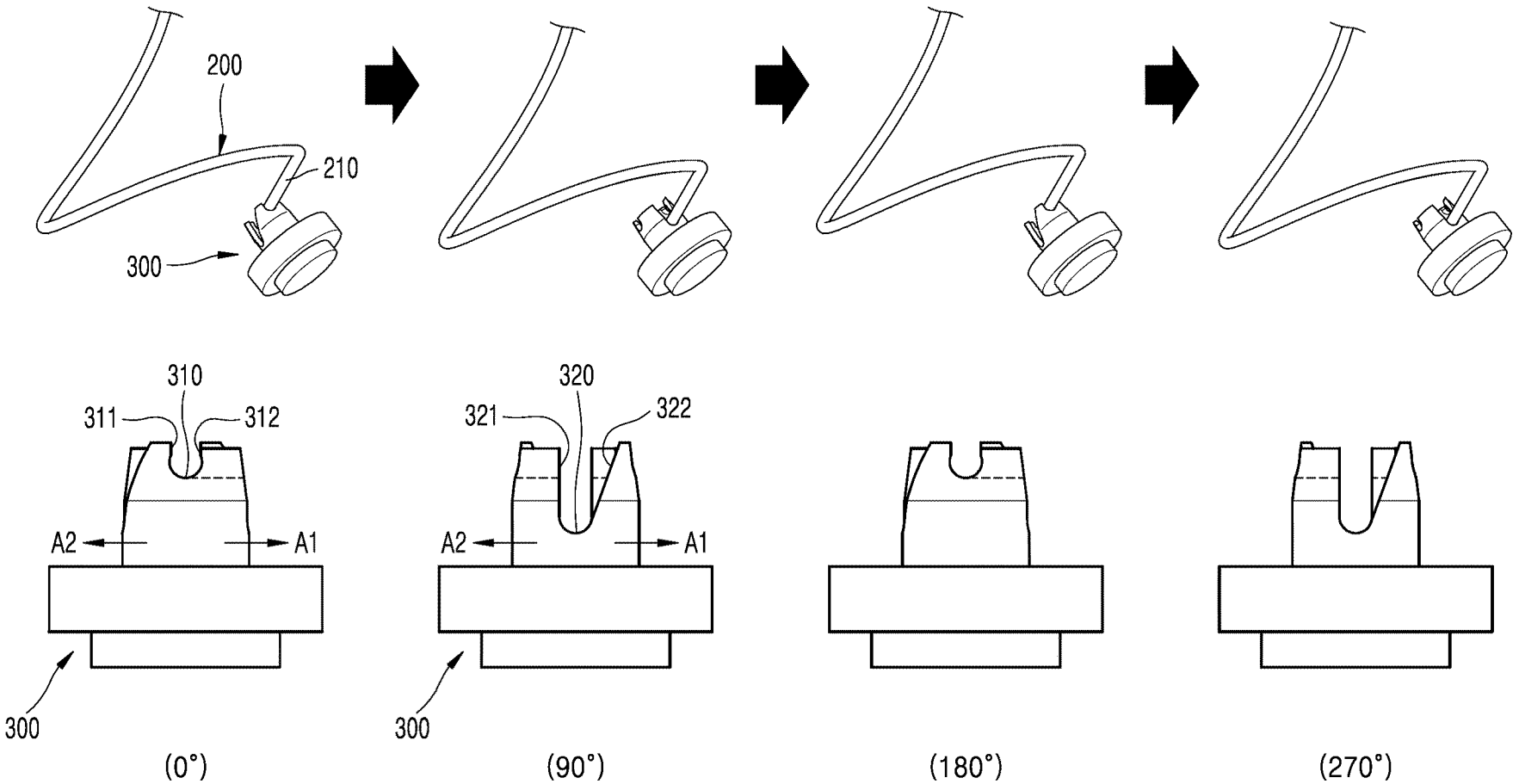
FIG. 9 illustrates a rotation member according to an example, showing a rotational phase of the rotation member respectively at 0 degrees, 90 degrees, 180 degrees, and 270 degrees.

In the rotation member 300, a plurality of first supporting portions 310 and a plurality of second supporting portion 320 may be alternately arranged in a circumferential direction. FIG. 9 illustrates a rotation member 300 according to an example, showing a rotational phase of the rotation member 300 respectively at 0 degrees, 90 degrees, 180 degrees, and 270 degrees. Referring to FIG. 9, the first support portion 310 and the second support portion 320 are apart at 90 degrees, and two pairs of the first support portion 310 and the second support portion 320 are arranged in a circumferential direction. A wall 322 of the second support portion 320 in the forward direction A1 is inclined with respect to the axial direction C such that, when the rotation member 300 is rotated in the reverse direction A2, the one end 210 of the spring auger 200 is deviated from the second support portion 320 and supported by the first support portion 310 located in the forward direction A1. According to this configuration, by rotating the rotation member 300 in the reverse direction A2, the one end 210 of the spring auger 200 is sequentially supported by the first support portion 310, the second support portion 320, the first support portion 310, and the second support portion 320 such that a section where a developer remains on the bottom surface 103 may be sequentially varied from a period of separation SP, a period of separation SP1, and the period of separation SP. Thus, an amount of a developer remaining in the period of separation SP and the period of separation SP1 may be reduced to further increase a use efficiency of the developer.

The first support portion 310 may have a concave shape having the wall 311 in the reverse direction A2 and the wall 312 in the forward direction A1 as illustrated by a solid line in FIG. 9. In this case, when the rotation member 300 is rotated in the reverse direction A2, the one end 210 of the spring auger 200 is deviated from the first support portion 310 over the wall 312 to be supported by the second support portion 320. A shape of the first support portion 310 may include the wall 311 in the reverse direction A2 as marked by a broken line illustrated in FIG. 9, and the wall 312 in the forward direction A1 may be omitted.

Figure 10:
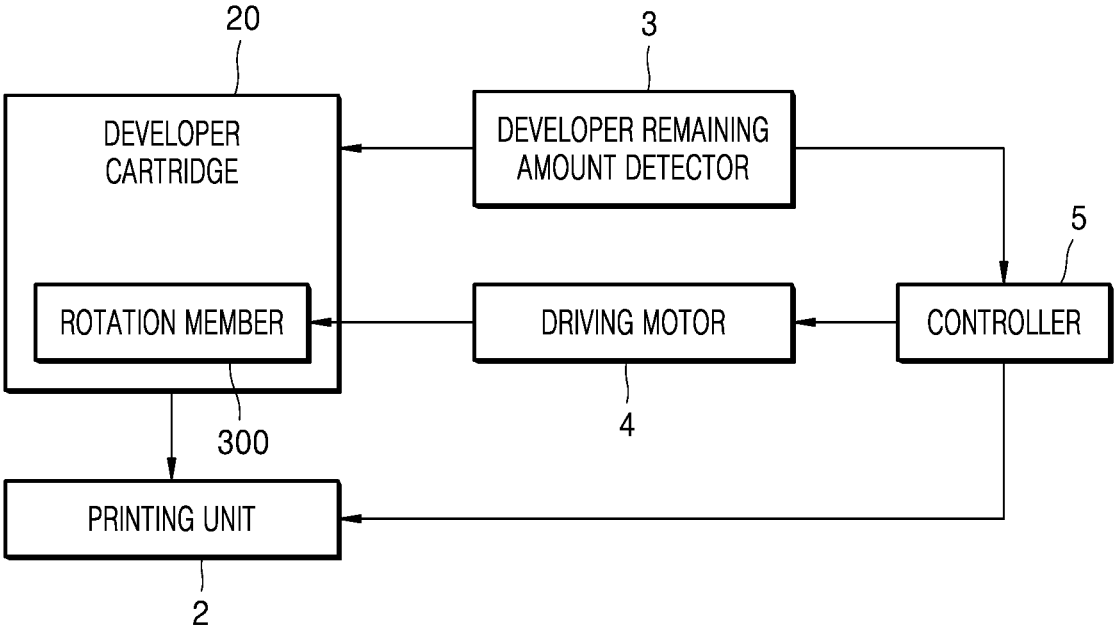
FIG. 10 is a block diagram illustrating an image forming apparatus including the developer cartridge illustrated in FIGS. 6 through 9, according to an example.

FIG. 10 is a block diagram illustrating an image forming apparatus including the developer cartridge 20 illustrated in FIGS. 6 through 9, according to an example. Referring to FIGS. 10, the image forming apparatus includes a printing unit 2 printing an image on a print medium P by receiving a developer from the developer cartridge 20, a developer remaining amount detector 3 detecting a remaining amount of a developer of the developer cartridge 20, a driving motor 4 rotating the rotation member 300, and a controller 5 controlling the driving motor 4 such that the rotation member 300 is rotated in the reverse direction A2 and then rotated again in the forward direction A1 when a detected remaining amount of developer is equal to or less than a reference remaining amount.

The printing unit 2 may print an image on the print medium P by using an electrophotographic method, and may have the structure illustrated in and described with reference to FIG. 1.

The driving motor 4 may be a motor used to drive components of the printing unit 2. In this case, when the developer cartridge 20 is mounted in the printing unit 2, the rotation member 300 may be connected to the driving motor 4 and rotated. The driving motor 4 may be a motor provided in the developer cartridge 20 to rotate the rotation member 300. In this case, when the developer cartridge 20 is mounted in the printing unit 2, the driving motor 4 may be connected to the controller 5.

The developer remaining amount detector 3 may detect a developer remaining amount of the developer cartridge 20 by using various methods. For example, a method of detecting a developer remaining amount from an amount of consumed developer based on the number of printing pixels, a method of detecting a developer remaining amount from an amount of consumed developer based on a driving time of the driving motor 4 for supplying a developer to the printing unit 2, or the like may be used. The above-described methods do not include actual measurement of a consumed amount of developer, but include predicting an amount of consumed developer based on the number of printing pixels and a driving time of the driving motor 4 and detecting a developer remaining amount based on the predicted amount of consumed developer.

The developer remaining amount detector 3 may directly detect a remaining amount of developer inside the developer cartridge 20. In this case, the developer remaining amount detector 3 may include a developer remaining amount sensor (not shown) arranged adjacent to the developer discharge outlet 101 of the housing 100 to generate an electrical detection signal based on a developer remaining amount. The developer remaining amount sensor may be located downstream of the developer discharge outlet 101 with respect to a direction in which a developer is transported by the spring auger 200. The structure of the developer remaining amount sensor is not particularly limited. The developer remaining amount sensor may include a circuit used to detect a variation in inductance based on a remaining amount of developer. For example, the developer remaining amount sensor, may include an L-C circuit. When a conductor approaches a coil of the L-C circuit, inductance of the L-C circuit is varied. As a carrier accommodated in a developer contains an iron component, inductance of the L-C circuit is varied based on an amount of developer near the developer remaining amount sensor. Thus, a developer remaining amount may be detected based on the variation in the inductance.

The developer remaining amount detector 3 may also detect a developer remaining amount of the developer cartridge 20 by performing both a method of detecting a developer remaining amount based on a predicted amount of consumed developer and a method of detecting a developer remaining amount by using the developer remaining amount sensor.

The developer remaining amount detector 3 sends a detection signal corresponding to a developer remaining amount to the controller 5. The controller 5 compares the detected developer remaining amount with a preset reference remaining amount. The reference remaining, amount may be, for example, about 10% of an initial amount of developer accommodated in the developer cartridge 20. When the detected developer remaining amount is equal to or less than the preset reference remaining amount, the controller 5 controls the driving motor 4 such that the rotation member 300 is rotated in the reverse direction A2. Then the one end 210 of the spring auger 200 is deviated from the first support portion 310 and supported by the second support portion 320, and a pitch of the spring auger 200 is varied. Next, the controller 5 controls the driving motor 4 such that the rotation member 300 is rotated in the forward direction A1 again. Then, as described above, at least a portion of developer remaining in an area corresponding to the period of separation SP of the bottom surface 103 of the housing 100 may be transported to the developer discharge outlet 101, thereby increasing a use efficiency of the developer. In addition, when the rotation member 300 in the form as illustrated in FIG. 9 is included, and a detected developer remaining amount is equal to or less than a preset reference remaining amount, rotation of the rotation member 300 in the forward direction A1 and rotation of the rotation member 300 in the reverse direction A2 may be repeated to transport a developer remaining in an area corresponding to the period of separation SP and the period of separation SP1 of the bottom surface 103 of the housing 100 to the developer discharge outlet 101, thereby further increasing a use efficiency of the developer.

While examples have been described with reference to the figures, it will be understood by those of ordinary skill in the art that various changes in form and details may be made therein without departing from the spirit and scope as defined by the following claims.

What is claimed is:

1. A developer cartridge, comprising:

a housing accommodating a developer, the housing including a first end portion and a second end portion, the first end portion and the second end portion being respectively located at opposite ends of the housing in a lengthwise direction, the housing is to discharge the developer through a developer discharge outlet coupled to the housing and adjacent to one of the first end portion and the second end portion;

a spring auger located inside the housing and to rotate to transport the developer to the developer discharge outlet; and a rotation member located at the first end portion of the housing and connected to a first end of the spring auger to rotate the spring auger, wherein a bottom surface of the housing includes a plurality of first portions and a plurality of second portions, the first portions being flat and the second portions being internally convex from the first portions, a first portion of the plurality of first portions being adjacent to a respective second portion of the plurality of second portions, the first portions and the second portions are repeatedly arranged on the bottom surface of the housing in the lengthwise direction, and wherein a spiral portion of the spring auger is to contact the bottom surface of the housing when the spring auger is rotated.

2. The developer cartridge of claim 1, wherein a second end of the spring auger is a free end.

3. The developer cartridge of claim 1, wherein a second end of the spring auger is rotatably supported by the housing.

4. The developer cartridge of claim 1, wherein a repeated arrangement cycle of the first portions and the second portions of the bottom surface is equal to a pitch of the spring auger.

5. The developer cartridge of claim 1, wherein the spring auger comprises a connection portion connected to the rotation member, an extension portion extending from the connection portion in a radial direction, and the spiral portion extending from the extension portion in the lengthwise direction, and the first portions and the second portions of the bottom surface are synchronized with a rotational phase of the extension portion.

6. The developer cartridge of claim 5, wherein, when a position where the extension portion faces the bottom surface is a reference rotational position, and positions where the spiral portion faces the bottom surface when the spring auger is at the reference rotational position, and is rotated from the reference rotational position by 90 degrees, 180 degrees, and 270 degrees, respectively comprise a first position, a second position, a third position, and a fourth position, the second portion of the bottom surface is formed from the first position to at least the third position.

7. The developer cartridge of claim 6, wherein the second portion of the bottom surface is formed from the first position to the fourth position.

8. The developer cartridge of claim 1, wherein a repeated arrangement cycle of the first portions and the second portions of the bottom surface is based on a pitch of the spring auger.

9. A developer cartridge, comprising:

a housing accommodating a developer, the housing including a first end portion and a second end portion, the first end portion and the second end portion being respectively located at opposite ends of the housing in a lengthwise direction, the housing is to discharge the developer through a developer discharge outlet coupled to the housing and adjacent to one of the first end portion and the second end portion;

a spring auger located inside the housing and to rotate to transport the developer to the developer discharge outlet; and a rotation member located at the first end portion of the housing and connected to a first end of the spring auger to rotate the spring auger, wherein a bottom surface of the housing includes a plurality of first portions and a plurality of second portions, the first portions being flat and the second portions being internally convex from the first portions, a first portion of the plurality of first portions being adjacent to a respective second portion of the plurality of second portions, the first portions and the second portions are repeatedly arranged on the bottom surface of the housing in the lengthwise direction, wherein a repeated arrangement cycle of the first portions and the second portions of the bottom surface is equal to a pitch of the spring auger, and wherein a length of the second portion of the plurality of second portions of the bottom surface is longer than a length of the first portion of the plurality of first portions of the bottom surface.

10. An image forming apparatus comprising:

a developer cartridge, comprising:

a housing accommodating a developer, the housing including a first end portion and a second end portion, the first end portion and the second end portion being respectively located at opposite ends of the housing in a lengthwise direction, the housing is to discharge the developer through a developer discharge outlet coupled to the housing and adjacent to one of the first end portion and the second end portion;

a spring auger located inside the housing and being rotatable to transport the developer to the developer discharge outlet; and a rotation member located at the first end portion of the housing and connected to a first end of the spring auger to rotate the spring auger, wherein a bottom surface of the housing includes a plurality of first portions and a plurality of second portions, the first portions being flat and the second portions being internally convex from the first portions, a first portion of the plurality of first portions being adjacent to a respective second portion of the plurality of second portions, the first portions and the second portions are repeatedly arranged on the bottom surface of the housing in the lengthwise direction, and wherein a spiral portion of the spring auger is to contact the bottom surface of the housing when the spring auger is rotated; and a printing unit to print an image on a print medium by receiving the developer from the developer cartridge.

11. The image forming apparatus of claim 10, wherein a second end of the spring auger is a free end.

12. The image forming apparatus of claim 10, wherein a second end of the spring auger is rotatably supported by the housing.

13. The image forming apparatus of claim 10, wherein a repeated arrangement cycle of the first portions and the second portions of the bottom surface is based on a pitch of the spring auger.

14. The image forming apparatus of claim 13, wherein a length of the second portion of the plurality of second portions of the bottom surface is longer than a length of the first portion of the plurality of first portions of the bottom surface.

15. The image forming apparatus of claim 10, wherein the spring auger comprises a connection portion connected to the rotation member, an extension portion extending from the connection portion in a radial direction, and the spiral portion extending from the extension portion in the lengthwise direction, and the first portions and the second portions of the bottom surface are synchronized with a rotational phase of the extension portion.

16. The image forming apparatus of claim 15, wherein, when a position where the extension portion faces the bottom surface is a reference rotational position, and positions where the spiral portion faces the bottom surface when the spring auger is at the reference rotational position, and is rotated from the reference rotational position by 90 degrees, 180 degrees, and 270 degrees, respectively comprise a first position, a second position, a third position, and a fourth position, the second portion of the bottom surface is formed from the first position to at least the third position.

17. The image forming apparatus of claim 16, wherein the second portion of the bottom surface is formed from the first position to the fourth position.

* * * * *